US009541344B2

(12) United States Patent
Moon

(10) Patent No.: US 9,541,344 B2
(45) Date of Patent: Jan. 10, 2017

(54) FIREARM COMPENSATOR ASSEMBLY

(71) Applicant: Saeilo Enterprises, Inc., Pomona, NY (US)

(72) Inventor: Kook Jin Moon, Matamoras, PA (US)

(73) Assignee: SAEILO ENTERPRISES, INC., Greeley, PA (US)

( * ) Notice: Subject to any disclaimer, the term of this patent is extended or adjusted under 35 U.S.C. 154(b) by 0 days.

(21) Appl. No.: 14/798,511

(22) Filed: Jul. 14, 2015

(65) Prior Publication Data

US 2016/0010936 A1 Jan. 14, 2016

Related U.S. Application Data

(60) Provisional application No. 62/024,102, filed on Jul. 14, 2014.

(51) Int. Cl.
*F41A 21/38* (2006.01)
*F41A 21/36* (2006.01)

(52) U.S. Cl.
CPC ..... *F41A 21/36* (2013.01); *F41A 21/38* (2013.01)

(58) Field of Classification Search
CPC ..... F41A 21/36; F41A 21/38; F41A 31/32; F41A 21/32
USPC ..... 89/14.2, 14.3, 14.4
See application file for complete search history.

(56) References Cited

U.S. PATENT DOCUMENTS 3,208,348 A 9/1965 Lee
4,691,614 A 9/1987 Leffel
4,930,396 A 6/1990 Johnson
5,076,137 A 12/1991 Paredes
5,105,717 A 4/1992 Pond
5,305,677 A 4/1994 Kleinguenther
5,305,678 A 4/1994 Talbot
5,317,825 A 6/1994 Vatterott
5,549,030 A 8/1996 Lespron
5,563,362 A 10/1996 York
5,698,810 A 12/1997 Rose
7,748,306 B1 7/2010 Curry
8,387,299 B1 * 3/2013 Brittingham ..... F41A 21/30 42/90
2005/0188829 A1 9/2005 Hanslick
2011/0252952 A1 * 10/2011 McNeill ..... F41A 21/38 89/14.3
2015/0253098 A1 * 9/2015 Russell ..... F41A 21/325 89/14.4

FOREIGN PATENT DOCUMENTS

EP 0943885 * 9/1999 ..... F41A 21/36

* cited by examiner

*Primary Examiner* — Stephen M Johnson
(74) *Attorney, Agent, or Firm* — Bennet K. Langlotz; Langlotz Patent & Trademark Works, Inc.

(57) ABSTRACT

A firearm compensator assembly includes a compensator base that may be mounted to a barrel of a firearm, the base having a contact surface. A cylindrical-shaped compensator body has a bore, an axis, a sidewall, a contact surface, an outer surface and at least one gas discharge port extending through the sidewall between the bore and the outer surface. A spring exerts a biasing force urging the body contact surface into engagement with the base contact surface whereby the body is locked to the base. The gas discharge port is rotatable around the axis by urging the body contact surface away from the base contact surface against the biasing force of the spring.

35 Claims, 5 Drawing Sheets

FIREARM COMPENSATOR ASSEMBLY

CROSS-REFERENCE TO RELATED APPLICATIONS

This application claims the benefit under 35 U.S.C. §119 (e) of U.S. Provisional Patent Application Ser. No. 62/024,102 filed Jul. 14, 2014.

BACKGROUND

This disclosure relates generally to a compensation system for a firearm. More particularly, this disclosure relates to a system and a method for attaching a compensator assembly adjacent a muzzle end of a barrel of a firearm.

When a round of ammunition is fired from a firearm, handguns in particular, it is often the case that the barrel end of the firearm will 'jump', or kick upwards, as a result of the discharge of the round. As will be appreciated, this movement may affect the accuracy of a given shot while also making the accuracy of subsequent discharges problematic. Moreover, muscular fatigue from the jump (or 'kick') of the firearm, following the discharge of the firearm, is also generated.

As a consequence of firearm jump, manufacturers and hobbyists have adapted their firearms to employ a compensator, which lessens, to a certain degree, the magnitude of the jump experienced by a firearm after discharge of a round. Typically, these compensators take the form of a plurality of slots, which are milled in the barrel itself, adjacent the distal muzzle end of the firearm.

Generally, the milled, compensator slots act to vent a portion of the gases associated with the discharge of the round from the firearm. As the milled slots are typically arranged on the upper surface of the barrel, the force of the gases exiting the discharge slots tend to urge the firearm in a downward direction, thus compensating to some extend for the jump experienced by the firearm.

While successful to a certain degree, the milling of compensator discharge slots in the barrel of a firearm tend to deface the barrel itself, while also interfering somewhat with the effectiveness of the lands and grooves, if present, of any rifling that may be milled on the interior surface of the barrel. Moreover, known compensators oftentimes do not produce the most optimized performance characteristics due to the size and location of the discharge slots.

With the forgoing problems and concerns in mind, it is the general object of the present invention to provide a novel compensation assembly for a firearm.

SUMMARY

There is provided a firearm compensator assembly comprising a compensator base adapted to be mounted to a barrel of a firearm. The base has a contact surface. A cylindrical-shaped compensator body has a bore, an axis, a sidewall, a contact surface, an outer surface and at least one gas discharge port extending through the sidewall between the bore and the outer surface. A spring exerts a biasing force urging the body contact surface into engagement with the base contact surface whereby the body is locked to the base. The gas discharge port is rotatable around the axis by urging the body contact surface away from the base contact surface against the biasing force of the spring.

The body bore includes a muzzle end portion and a breech end portion. The bore breech end portion has a diameter that is greater than the diameter of the bore muzzle end portion, forming a rearwardly facing shoulder defining the body contact surface.

The compensator base includes a flange segment having first and second faces, and a tubular sleeve segment extending from the flange segment second surface. The flange segment first surface defines the base contact surface.

The body contact surface has multiple radially protruding ridges defining ratchet teeth and the base contact surface has multiple radially protruding ridges defining ratchet teeth. The body ratchet teeth engage the base ratchet teeth to lock the body to the base.

The base flange segment has a diameter that is greater than the diameter of the compensator body bore muzzle end portion and less than the diameter of the compensator body bore breech end portion, whereby the compensator base is slidably movable within the compensator body bore breech end portion.

The compensator base bore has a threaded inner surface adapted to threadably engage a threaded portion of the firearm barrel.

The firearm compensator assembly also comprises a washer-shaped lock bushing having an axial opening extending from the front surface to the rear surface. The opening has a diameter that is greater than an outside diameter of the compensator base sleeve segment, whereby the lock bushing is slidably movable along the compensator base sleeve segment.

The firearm compensator assembly further comprises multiple fasteners. The compensator base flange segment is positioned within the compensator body bore breech end portion, the spring is positioned around the compensator base sleeve segment, and the compensator base sleeve segment is positioned within the lock bushing axial opening. The fasteners are positioned within opening in the lock bushing and blind openings in the compensator body to mount the lock bushing to the compensator body and partially compress the spring.

There is also provided a firearm compensator assembly comprising a cylindrical-shaped compensator body having a bore, an axis, a sidewall, a contact surface, an outer surface, and at least one gas discharge port extending through the sidewall between the bore and the outer surface. The bore has a muzzle end portion and a breech end portion. A compensator base adapted to be mounted to a barrel of a firearm includes a flange segment disposed within the body bore breech end portion and a tubular sleeve segment extending rearwardly from the flange segment. The flange segment has a face defining a base contact surface. A washer-shaped lock bushing is disposed around the compensator base tubular sleeve segment. Multiple fasteners mount the lock bushing to the body sidewall. A spring is disposed around the compensator base tubular sleeve segment intermediate the lock bushing and the base flange segment. The spring exerts a biasing force urging the body contact surface into engagement with the base contact surface whereby the body is locked to the base. The gas discharge port is rotatable around the axis by urging the body contact surface away from the base contact surface against the biasing force of the spring.

The body bore breech end portion has a diameter that is greater than a diameter of the bore muzzle end portion, forming a rearwardly facing shoulder defining the body contact surface.

The compensator base flange segment has front and rear faces, the flange segment front surface defining the base contact surface.

The body contact surface has multiple radially protruding ridges defining ratchet teeth and the base contact surface has multiple radially protruding ridges defining ratchet teeth. The body ratchet teeth engage the base ratchet teeth to lock the body to the base.

The base flange segment has a diameter that is greater than the diameter of the compensator body bore muzzle end portion and less than the diameter of the compensator body bore breech end portion, whereby the compensator base is slidably movable within the compensator body bore breech end portion.

The compensator base bore has a threaded inner surface adapted to threadably engage a threaded portion of the firearm barrel.

The lock bushing has an axial opening extending from the front surface to the rear surface. The opening has a diameter that is greater than an outside diameter of the compensator base sleeve segment, whereby the lock bushing is slidably movable along the compensator base sleeve segment.

BRIEF DESCRIPTION OF THE DRAWINGS

The present disclosure may be better understood and its numerous objects and advantages will become apparent to those skilled in the art by reference to the accompanying drawings in which.

DETAILED DESCRIPTION

With reference to the drawings wherein like numerals represent like parts throughout the several figures, a firearm compensator assembly in accordance with the present disclosure is generally designated by the numeral 10.

Figure 1:
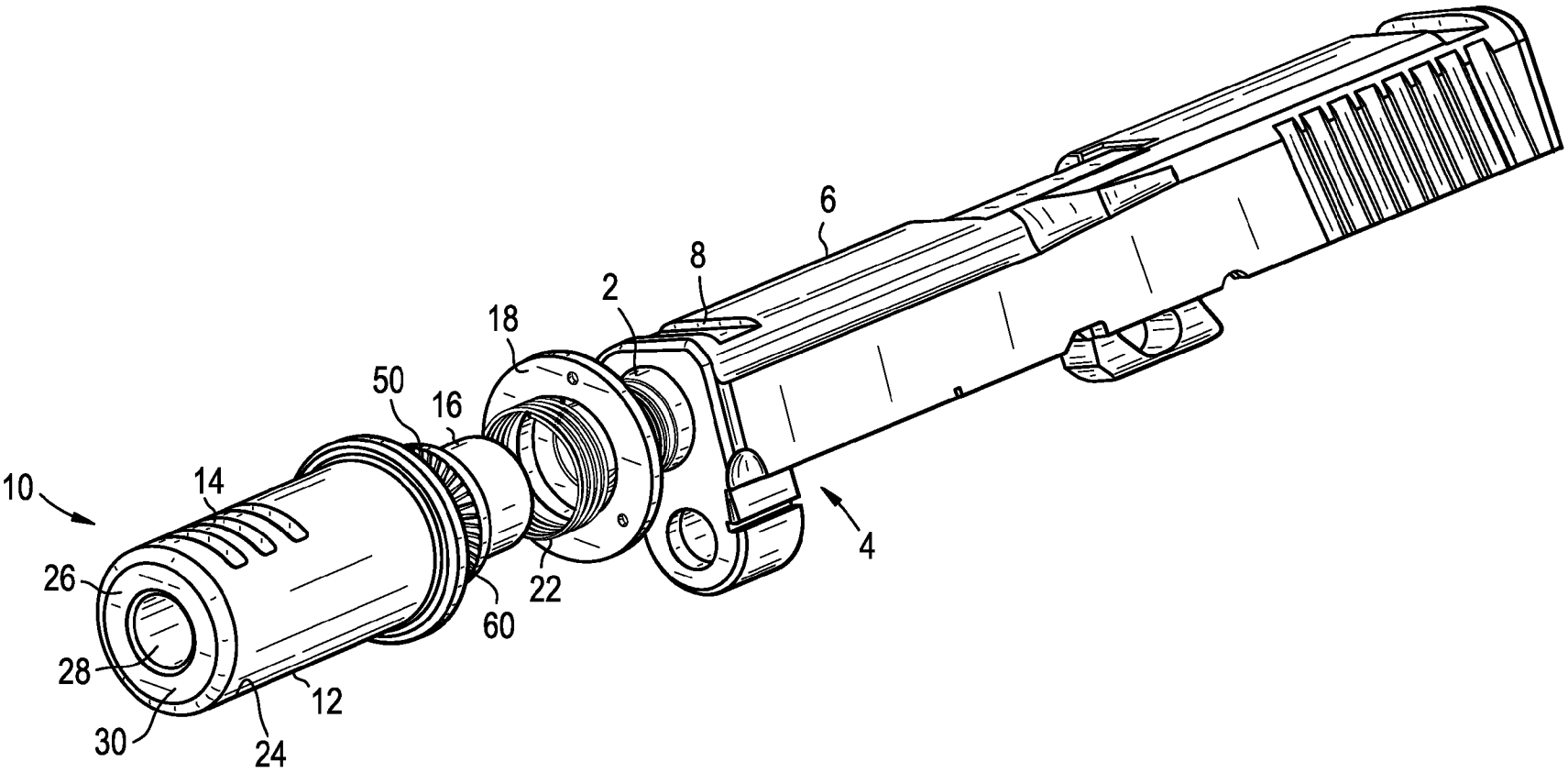
FIG. 1 is an exploded, front perspective view of a compensator assembly in accordance with the description and the muzzle end of a firearm.
Figure 2:
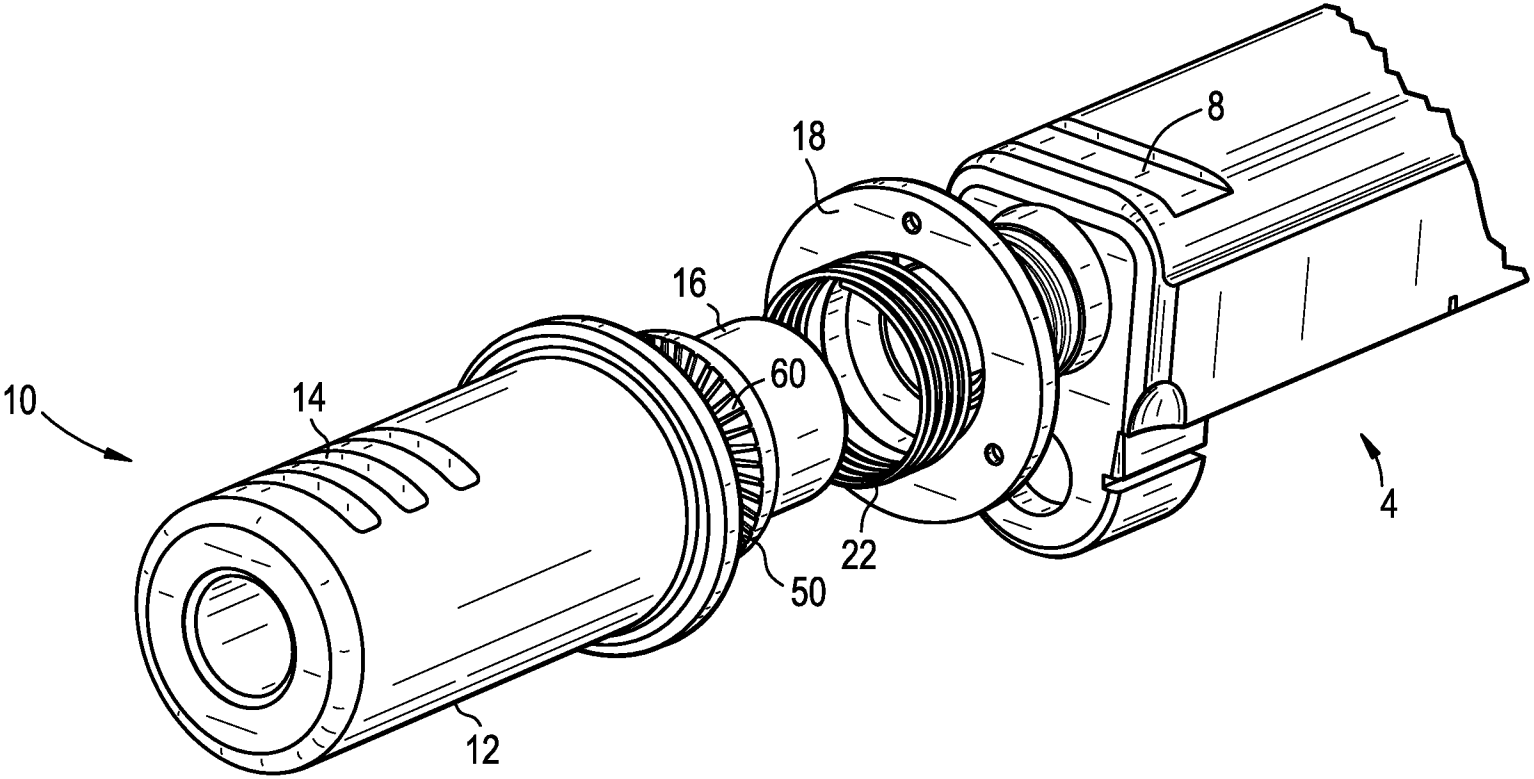
FIG. 2 is an enlarged exploded, front isometric view of the compensator assembly of FIG. 1 and the muzzle end of a firearm.
Figure 3:
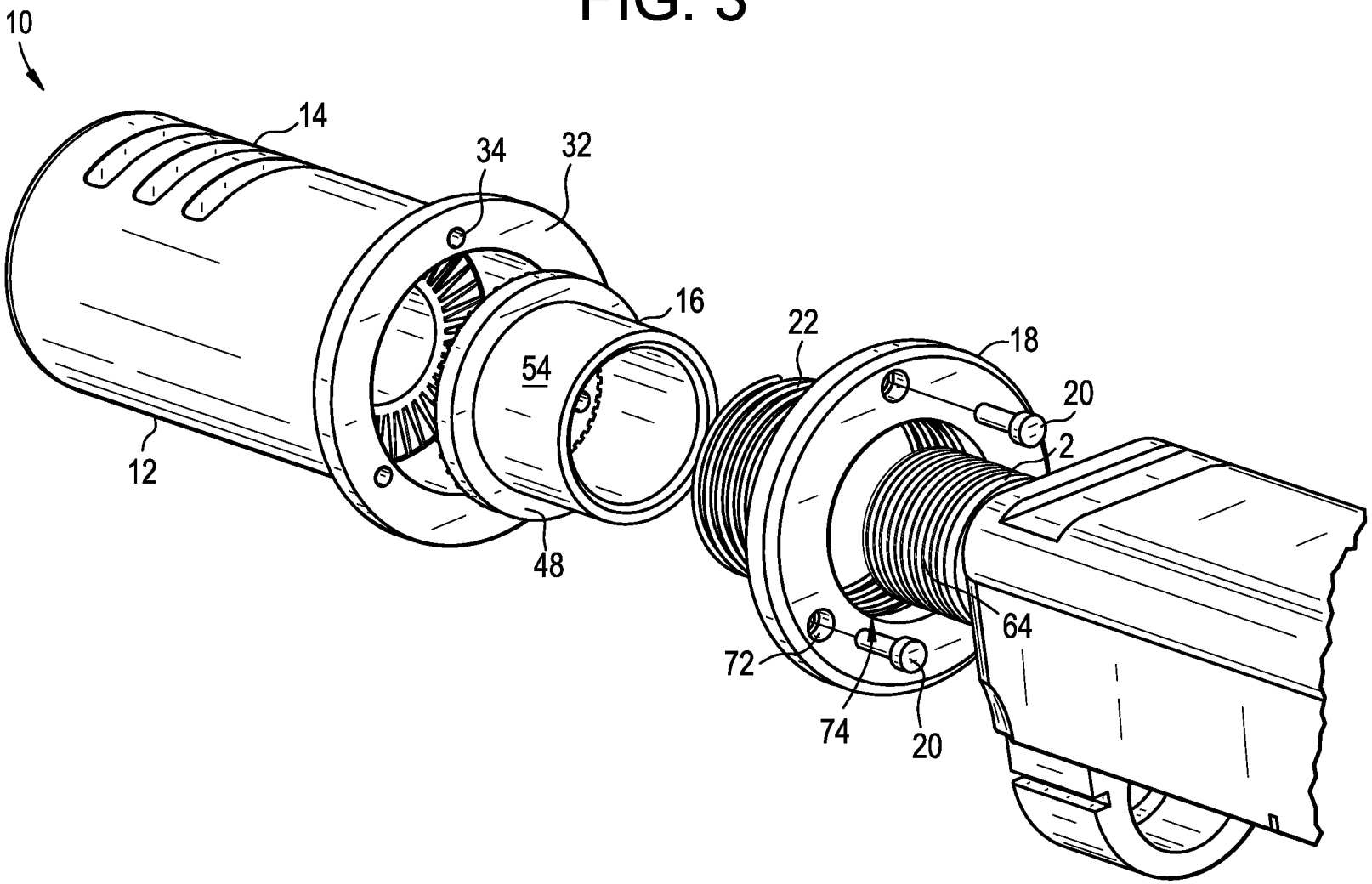
FIG. 3 is an exploded rear perspective view of the compensator assembly of FIG. 1 and the muzzle end of a firearm.
Figure 4:
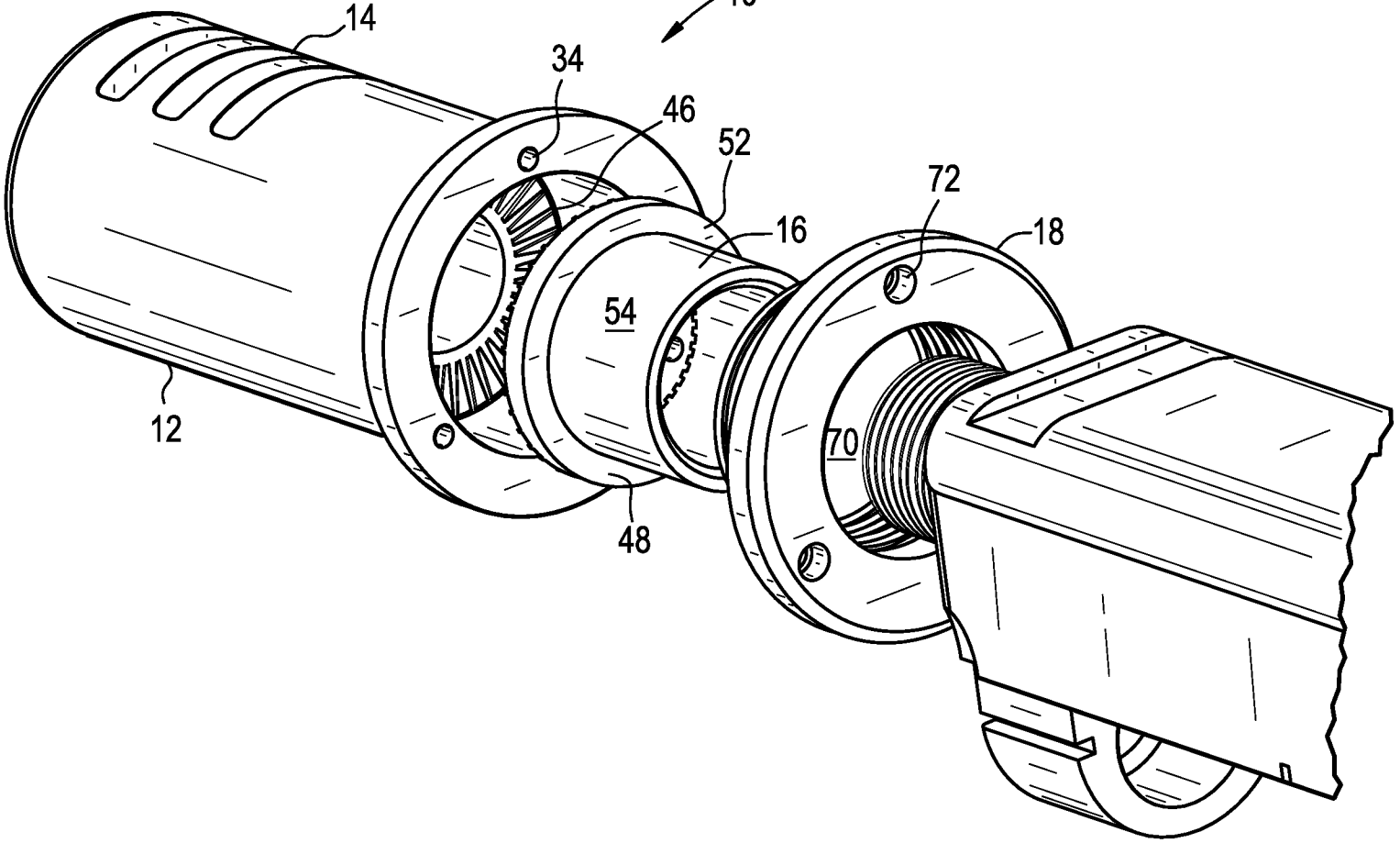
FIG. 4 is an enlarged exploded, rear isometric view of the compensator assembly of FIG. 1 and the muzzle end of a firearm.
Figure 5:
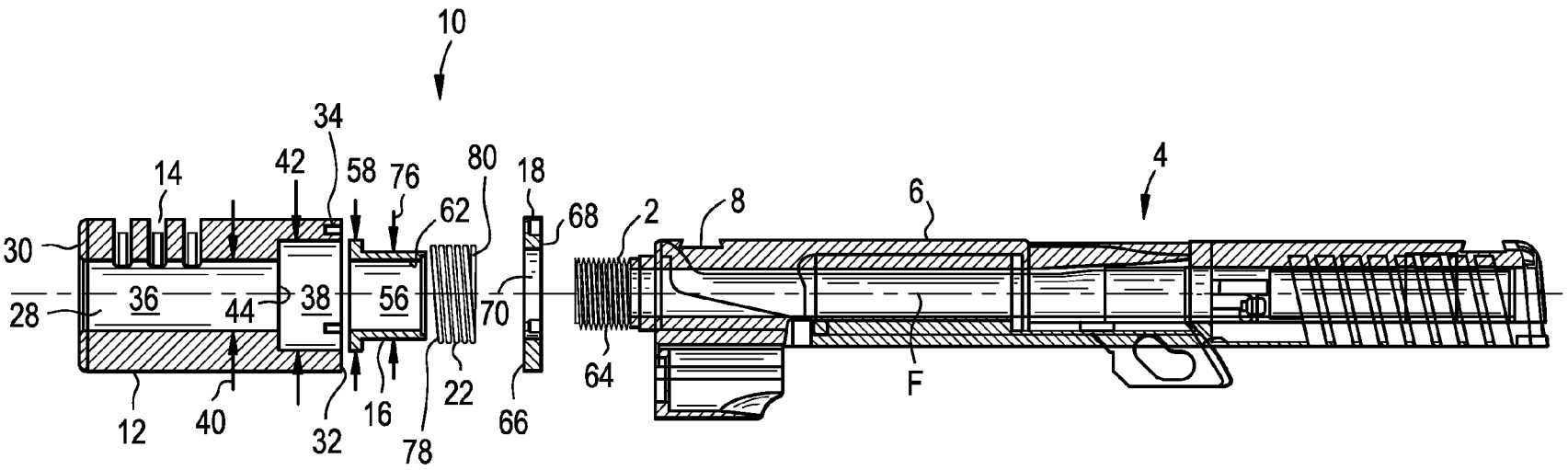
FIG. 5 is an exploded, side view in phantom of the compensator assembly of FIG. 1 and the muzzle end of a firearm.

FIG. 1 is an exploded, isometric view of a firearm compensator assembly 10 according to one embodiment of the present invention. In the example shown in the figures, the firearm is a pistol. However, it should be appreciated that the subject firearm compensator may be used with other types of firearms, for example long arms and revolvers.

With additional reference to FIGS. 2-5, the barrel 2 defines a firing axis F and may be disposed within a firearm shroud 4, for example a pistol slide, although alternative designs, such as but not limited to fixed barrel and shroud designs, are equally contemplated by the present invention. The upper surface 6 of the barrel shroud 4 is substantially flat and may have an axially elongated, upwardly open, sight receiving groove 8 formed therein which comprises a sight positioning portion of the shroud 4.

The compensator assembly 10 includes a compensator body 12 having multiple arcuate gas discharge ports 14, a compensator base 16 that facilitates the mounting of the compensator assembly 10 onto a firearm barrel 2, a lock bushing 18, fasteners 20 and a spring 22.

The cylindrical-shaped compensator body 12 has an outer surface 24, a sidewall 26 and a stepped axial bore 28 extending from a muzzle end face 30 to a breech end face 32. Multiple, spaced, blind openings 34 extend forward from the breech end face 32. The muzzle end and breech end portions 36, 38 of the bore 28 each have a diameter 40, 42, with the diameter 42 of the bore breech end portion 38 being greater than the diameter 40 of the bore muzzle end portion 36, forming a rearwardly facing shoulder surface 44 having multiple, radially extending ridges protruding therefrom, forming ratchet teeth 46.

The gas discharge ports 14 are disposed in the muzzle end portion of the sidewall 26, extending from the bore muzzle end portion 36 to the outer surface 24. Although the gas discharge ports 14 have been described as being arcuate in form, the present invention is not limited in this regard as other, alternative shapes may be defined by the gas discharge ports 14 without departing from the broader aspects of the present invention. Indeed, the gas discharge ports 14 need not take the form of 'slots' per se, instead being formed as geometric openings of any predetermined size, shape and angular inclination in accordance with the preferred design characteristics of the compensator assembly 10, as will be discussed in greater detail later.

The compensator base 16 includes a flange segment 48 having first and second faces 50, 52, a tubular sleeve segment 54 extending from the flange segment second surface 52 and an axial bore 56. The outer diameter 58 of the flange segment 48 is greater than the diameter 40 of the compensator body bore muzzle end portion 36 and less than the diameter 42 of the compensator body bore breech end portion 38, whereby the compensator base 16 is slidably movable within the compensator body bore breech end portion 38. Multiple, radially extending ridges protrude from the flange segment first face 50, forming ratchet teeth 60. The compensator base bore 56 has a threaded inner surface 62 that threadably engages the threaded portion 64 of the barrel outer surface to mount the compensator assembly 10 to the barrel 2, as described below.

The washer-shaped lock bushing 18 has front and rear surfaces 66, 68, an axial opening 70 extending from the front surface 66 to the rear surface 68 and multiple, spaced openings 72 disposed around the axial opening 70. The diameter 74 of the lock bushing axial opening 70 is greater than the outside diameter 76 of the compensator base sleeve segment 54, whereby the lock bushing 18 is slidably movable along the compensator base sleeve segment 54.

During manufacture, the compensator base flange segment 48 is positioned within the compensator body bore breech end portion 38. The spring 22 is positioned around the compensator base sleeve segment 54 with spring muzzle end 78 engaging the flange segment second face 52. The compensator base sleeve segment 54 is inserted through the lock bushing axial opening 70, whereby the spring breech end 80 engages the lock bushing front surface 66. The lock bushing 18 is then pushed forward causing the compensator base flange segment 48 to move forward within the compensator body bore breech end portion 38 until the flange segment first face 50 contacts the compensator body shoulder surface 44 whereby the compensator base ratchet teeth 46 engage the compensator body ratchet teeth 60. The lock bushing 18 is then pushed forward until the lock bushing front surface 66 contacts the compensator body breech end face 32, thereby partially compressing the spring 22, and mounted to the compensator body 12 by multiple fasteners 20 inserted through the lock bushing openings 72 into the compensator body blind openings 34.

The compensator system 10 is mounted to a firearm by threading the compensator base sleeve segment 54 onto the barrel outer surface threaded portion 64. After the compensator base 16 is tightened on the barrel 2, the compensator ports 14 are aligned by pulling the compensator body 12 forward against the force of the spring 22 to disengage the compensator body ratchet teeth 60 from the compensator body ratchet teeth 46. The compensator body 12 may then be rotated until ports 14 are aligned in the desired position. Releasing the compensator body 12 allows the spring 22 to urge the compensator body ratchet teeth 60 into engagement with the compensator base ratchet teeth 46, whereby the compensator body 12 is locked in position.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A firearm compensator assembly comprises:

a compensator base adapted to be threadably mounted to a barrel of a firearm, the base having a contact surface;

a cylindrical-shaped compensator body defining a bore and an axis, the body having a sidewall, a contact surface, an outer surface and a at least one gas discharge port extending through the sidewall between the bore and the outer surface; and a spring exerting a biasing force urging the body contact surface into engagement with the base contact surface whereby the body is locked to the base;

wherein the gas discharge port is permitted to rotate around the axis by urging the body contact surface away from the base contact surface against the biasing force of the spring.

2. The firearm compensator assembly of claim 1, wherein the body bore includes a muzzle end portion and a breech end portion, the bore breech end portion having a diameter that is greater than a diameter of the bore muzzle end portion, forming a rearwardly facing shoulder defining the body contact surface.

3. The firearm compensator assembly of claim 2 wherein the compensator base includes a flange segment having first and second faces, and a tubular sleeve segment extending from the flange segment second surface, the flange segment first surface defining the base contact surface.

4. The firearm compensator assembly of claim 3 wherein the body contact surface has a plurality of ridges protruding radially therefrom defining ratchet teeth and the base contact surface has a plurality of ridges protruding radially therefrom defining ratchet teeth, the body ratchet teeth engaging the base ratchet teeth to lock the body to the base.

5. The firearm compensator assembly of claim 3 wherein the base flange segment has a diameter that is greater than the diameter of the compensator body bore muzzle end portion and less than the diameter of the compensator body bore breech end portion, whereby the compensator base is slidably movable within the compensator body bore breech end portion.

6. The firearm compensator assembly of claim 3 wherein the base defines an axial bore extending through the flange segment and the sleeve segment.

7. The firearm compensator assembly of claim 6 wherein the compensator base bore has a threaded inner surface adapted to threadably engage a threaded portion of the firearm barrel.

8. The firearm compensator assembly of claim 3 further comprising a washer-shaped lock bushing having a front surface and a rear surface, and defining an axial opening extending from the front surface to the rear surface, the opening having a diameter that is greater than an outside diameter of the compensator base sleeve segment, whereby the lock bushing is slidably movable along the compensator base sleeve segment.

9. The firearm compensator assembly of claim 8 further comprising:

a plurality of fasteners;

the compensator body defining a plurality of spaced, blind openings extending forward from a breech end face; and the lock bushing defining a plurality of spaced openings disposed around the opening;

wherein the compensator base flange segment is positioned within the compensator body bore breech end portion, the spring is positioned around the compensator base sleeve segment, the compensator base sleeve segment is positioned within the lock bushing axial opening, the fasteners are positioned within the lock bushing openings and the compensator body blind openings whereby the lock bushing is mounted to the compensator body and the spring is partially compressed.

10. The firearm compensator assembly of claim 1 wherein the at least one compensator body gas discharge port has an arcuate shape.

11. The firearm compensator assembly of claim 2 wherein the at least one gas discharge port is disposed in a muzzle end portion of the sidewall.

12. A firearm compensator assembly comprises:

a cylindrical-shaped compensator body defining a bore and an axis, the bore having a muzzle end portion and a breech end portion, the body including a sidewall, a contact surface, an outer surface, and at least one gas discharge port extending through the sidewall between the bore and the outer surface;

a compensator base adapted to be mounted to a barrel of a firearm, the base including a flange segment disposed within the body bore breech end portion, the flange segment having a face defining a base contact surface, and a tubular sleeve segment extending rearwardly from the flange segment;

a washer-shaped lock bushing disposed around the compensator base tubular sleeve segment;

a plurality of fasteners mounting the lock bushing to the body sidewall; and a spring disposed around the compensator base tubular sleeve segment intermediate the lock bushing and the base flange segment, the spring exerting a biasing force urging the body contact surface into engagement with the base contact surface whereby the body is locked to the base;

wherein the gas discharge port is rotatable around the axis by urging the body contact surface away from the base contact surface against the biasing force of the spring.

13. The firearm compensator assembly of claim 12, wherein the body bore breech end portion has a diameter that is greater than a diameter of the bore muzzle end portion, forming a rearwardly facing shoulder defining the body contact surface.

14. The firearm compensator assembly of claim 13 wherein the compensator base flange segment has front and rear faces, the flange segment front surface defining the base contact surface.

15. The firearm compensator assembly of claim 14 wherein the body contact surface has a plurality of ridges protruding radially therefrom defining ratchet teeth and the base contact surface has a plurality of ridges protruding radially therefrom defining ratchet teeth, the body ratchet teeth engaging the base ratchet teeth to lock the body to the base.

16. The firearm compensator assembly of claim 12 wherein the base flange segment has a diameter that is greater than the diameter of the compensator body bore muzzle end portion and less than the diameter of the compensator body bore breech end portion, whereby the compensator base is slidably movable within the compensator body bore breech end portion.

17. The firearm compensator assembly of claim 12 wherein the compensator base bore has a threaded inner surface adapted to threadably engage a threaded portion of the firearm barrel.

18. The firearm compensator assembly of claim 12 wherein the lock bushing has a front surface and a rear surface, and defines an axial opening extending from the front surface to the rear surface, the opening having a diameter that is greater than an outside diameter of the compensator base sleeve segment, whereby the lock bushing is slidably movable along the compensator base sleeve segment.

19. A muzzle device for a firearm having a barrel defining a bore, the muzzle device comprising:

a base having a threaded surface adapted to be mounted on the barrel;

the base defining a base bore registered with the barrel bore when the mounting facility is mounted on the barrel;

a body rotatably mounted to the base and defining a body bore;

the body bore registered with the base bore;

the body rotatable with respect to the base about a rotation axis defined by the bore of the barrel;

the body defining a gas discharge port communicating with the body bore and extending away from the bore; and the base and the body engaging each other with a detent mechanism having a plurality of stable positions, each stable position being a different angular position of the body with respect to the base.

20. The muzzle device of claim 19 wherein the body is an elongated cylinder having a cylindrical sidewall and the port extends laterally through the sidewall.

21. The muzzle device of claim 19 wherein the body has a solid sidewall portion opposite the port, such that the port generates a lateral force on the body in response to exhaust of gases through the port.

22. The muzzle device of claim 19 including a plurality of ports arranged in a pattern, such that the ports generate a lateral force on the body in response to exhaust of gases through the port.

23. The muzzle device of claim 19 wherein the body is spring biased axially with respect to the base.

24. The muzzle device of claim 19 wherein the body is spring biased away from the firearm.

25. The muzzle device of claim 19 wherein at least one of the base and the body includes an articulated surface operably engaged by an engagement element on the other of the base and the body, the articulated surface including a plurality of engagement features providing the detent mechanism's plurality of positions based on which of the engagement feature is engaged by the engagement element.

26. The muzzle device of claim 25 wherein the articulated surface and engagement element are biased together.

27. The muzzle device of claim 25 wherein the engagement features are arranged to encircle the rotation axis of the body.

28. The muzzle device of claim 25 wherein each engagement feature is a radial ridge extending radially from the rotation axis.

29. The muzzle device of claim 25 wherein the articulated surface is formed on a flat shoulder surface oriented perpendicular to and concentric with the bore axis.

30. The muzzle device of claim 19 wherein each of the base and the body includes an articulated surface including a plurality of engagement features, each of the engagement features of the body engaging a respective engagement feature of the base.

31. The muzzle device of claim 19 wherein the base is internally threaded to connect to the barrel, and has a front face having a plurality of articulations comprising a portion of the detent mechanism.

32. The muzzle device of claim 19 wherein the body has a rear-facing surface face having a plurality of articulations comprising a portion of the detent mechanism.

33. The muzzle device of claim 19 wherein the body is axially movable between a first position rotationally engaged with the base, and a second position rotationally disengaged with the base.

34. The muzzle device of claim 33 wherein the body is spring biased to the first position.

35. The muzzle device of claim 33 wherein in the second position the body is farther away from the barrel than the in the first position.

* * * * *